US009080130B2

(12) United States Patent
Sivik et al.

(10) Patent No.: US 9,080,130 B2
(45) **Date of Patent: *Jul. 14, 2015**

(54) FABRIC TREATMENT COMPOSITIONS

(71) Applicant: The Procter & Gamble Company, Cincinnati, OH (US)

(72) Inventors: Mark Robert Sivik, Mason, OH (US); Rajan Keshav Panandiker, West Chester, OH (US); Travis Kyle Hodgdon, Cincinnati, OH (US); Lidiany Gonzalez, West Chester, OH (US); Ouidad Benlahmar, Mannheim (DE); Reinhold Joseph Leyrer, Dannstadt (DE); Volodymyr Boyko, Mannheim (DE); Jules Hanna Mikhael, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 118 days.

This patent is subject to a terminal disclaimer.

(21) Appl. No.: 13/898,564

(22) Filed: May 21, 2013

(65) Prior Publication Data

US 2013/0310301 A1 Nov. 21, 2013

Related U.S. Application Data

(60) Provisional application No. 61/649,534, filed on May 21, 2012.

(51) Int. Cl.

| | |
|---|---|
| ***C11D 3/37*** | (2006.01) |
| ***C11D 3/00*** | (2006.01) |
| ***C11D 1/62*** | (2006.01) |

(52) U.S. Cl.

CPC ..... *C11D 3/0015* (2013.01); *C11D 1/62* (2013.01); *C11D 3/37* (2013.01); *C11D 3/373* (2013.01)

(58) Field of Classification Search

CPC ..... C11D 3/0015; C11D 3/373
USPC ..... 510/466, 475, 522, 527
See application file for complete search history.

(56) References Cited

U.S. PATENT DOCUMENTS

| | | | | |
|---|---|---|---|---|
| 4,675,118 | A * | 6/1987 | Stanley et al. | 510/525 |
| 5,486,303 | A | 1/1996 | Capeci et al. | |
| 5,489,392 | A | 2/1996 | Capeci et al. | |
| 5,516,448 | A | 5/1996 | Capeci et al. | |
| 5,565,422 | A | 10/1996 | Del Greco et al. | |
| 5,569,645 | A | 10/1996 | Dinniwell et al. | |
| 5,574,005 | A | 11/1996 | Welch et al. | |
| 5,576,282 | A | 11/1996 | Miracle et al. | |
| 5,691,297 | A | 11/1997 | Nassano et al. | |
| 5,830,843 | A | 11/1998 | Hartman et al. | |
| 5,879,584 | A | 3/1999 | Bianchetti et al. | |
| 6,251,850 | B1 | 6/2001 | Clarke et al. | |
| 6,306,812 | B1 | 10/2001 | Perkins et al. | |
| 6,326,348 | B1 | 12/2001 | Vinson et al. | |
| 8,440,174 | B2 | 5/2013 | Panandiker et al. | |
| 8,586,015 | B2 | 11/2013 | Panandiker et al. | |
| 8,940,284 | B2 | 1/2015 | Panandiker et al. | |
| 2005/0245668 | A1 | 11/2005 | Green et al. | |
| 2006/0252668 | A1 | 11/2006 | Frankenbach et al. | |
| 2007/0293413 | A1 | 12/2007 | McFarland et al. | |
| 2010/0020632 | A1 | 1/2010 | Corominas | |
| 2011/0172137 | A1 | 7/2011 | Corominas et al. | |
| 2011/0269663 | A1 | 11/2011 | Clowes et al. | |
| 2011/0275553 | A1 | 11/2011 | Leopold et al. | |
| 2015/0093350 | A1 | 4/2015 | Panandiker et al. | |

FOREIGN PATENT DOCUMENTS

WO WO 2010/079100 A1 * 7/2010

OTHER PUBLICATIONS

Partial International Search; International Application No. PCT/US2013/041989; date of mailing Sep. 27, 2013; 8 pages.

* cited by examiner

*Primary Examiner* — John Hardee
(74) *Attorney, Agent, or Firm* — James F. McBride; Steven W. Miller

(57) ABSTRACT

The present invention relates to fabric treatment compositions containing multi-phase systems, polymers for use in multi-phase systems as well as products comprising such systems and methods of making and using same. Such treatment compositions may be used for example as laundry additives, and/or through the rinse to provide benefits including enhanced softening, color benefits, and wrinkle reduction.

18 Claims, No Drawings

FABRIC TREATMENT COMPOSITIONS

FIELD OF THE INVENTION

The present invention relates to fabric treatment compositions and processes of making and using same.

BACKGROUND OF THE INVENTION

Fabric treatment compositions typically comprise a solvent phase and a second particulate phase that is dispersed as discrete particulates in such solvent phase. Such particulates may be vesicles or coacervates. Such fabric treatment compositions may comprise other actives, such as silicone softener actives, that are found in the fabric treatment composition but outside the aforementioned particulates. Regardless of where such actives are found, it is desirable to increase the deposition efficiency of such actives and/or the stability of such compositions. Efforts have been made to increase the stability of such compositions by adding a variety of materials. Unfortunately, such materials typically increase the deposition efficiency at the expense of the fabric treatment compositions' stability.

Applicants discovered that the judicious selection of the type and level of the polymer and in certain aspects, scavenger and silicone, can provide improved deposition without compromising stability. While not being bound by theory, Applicants believe that the proper selection of such materials yields a stable colloidal glass comprised of hard and soft particles. The aforementioned soft particles enable the colloidal glass formation, through repulsive particle-particle interactions, to exhibit enhanced stability and enhanced deposition. Such soft particles can scavenge anionic surfactant and/or drive silicone and/or softener active deposition via silicone and/or softener active and surfactant coacervation. Thus, fabric treatment compositions comprising such particles have a surprising combination of stability and deposition efficiency. Such combination of stability and deposition efficiency can be surprisingly enhanced in certain aspects via the addition of an anionic surfactant scavenger as provided herein.

SUMMARY OF THE INVENTION

The present invention relates to fabric treatment compositions containing multi-phase compositions, polymers for use in multi-phase compositions as well as products comprising such compositions and methods of making and using same. Such treatment compositions may be used for example as laundry additives, and/or through the rinse to provide benefits including enhanced softening, color benefits, and wrinkle reduction.

DETAILED DESCRIPTION OF THE INVENTION

Definitions

As used herein, the term "fabric treatment composition" includes, unless otherwise indicated, laundry additives, fabric enhancers which can be used in a variety of manners, including as a rinse cycle treatment composition.

As used herein, a 'vesicle' is a spherical particle comprised of a solvent core surrounded by one or more membranes each independently comprising a surfactant, lipid or mixture thereof. In the event that there are multiple membranes each membrane is typically separated by a thin layer of solvent.

As used herein, a 'coacervate' is a dense liquid phase containing a macromolecular solution of poor solvent affinity. These macromolecule-rich fluids typically result from complexing a polyelectrolyte with an oppositely charged polyelectrolyte, surfactant, lipid or colloidal particles.

As used herein, the term "situs" includes paper products, fabrics, garments and hard surfaces.

As used herein, the term "micro-gel content" of a composition refers to the water-swellable polymer content of a composition, as determined by the Analytical Ultracentrifugation (AUC) technique described herein.

As used herein, articles such as "a", "an", and "the" when used in a claim, are understood to mean one or more of what is claimed or described.

Unless otherwise noted, all component or composition levels are in reference to the active level of that component or composition, and are exclusive of impurities, for example, residual solvents or by-products, which may be present in commercially available sources.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fabric Treatment Compositions

In one aspect, the fabric treatment compositions of the present invention may comprise, based upon total composition weight:

a) from about 0.05% to about 5%, from about 0.1% to about 3%, from about 0.2% to about 2%, from about 0.25% to about 1% of a dialkyl quaternary ammonium compound, in one aspect, said water-soluble dialkyl quaternary ammonium compound is optional b) from about 0.01% to about 1%, from about 0.05% to about 0.8%, from about 0.07% to about 0.6%, from about 0.1% to about 0.5%, from about 0.1% to about 0.3% of a polymeric material comprising one or more polymers said polymeric material having:

i. a viscosity slope of from about 3.7 to about 6.5, from about 3.7 to about 6, from about 3.9 to about 6, from about 4 to about 5.5, from about 4 to about 4.2 and/or having a micro gel content of greater than 60%, greater than 65%, greater than 67%, greater than 69% or from about 60% to about 90%, from about 65% to about 90%, from about 67% to about 87%, from about 69% to about 84%, from about 69% to about 80%;

ii. a viscosity slope of greater than 3.7, from about 3.7 to about 6.5, from about 3.7 to about 6, from about 3.9 to about 6, from about 4 to about 5.5, from about 4 to about 4.2 and/or having a micro gel content of greater than 65%, greater than 67%, greater than 69% or from about 65% to about 90%, from about 67% to about 87%, from about 69% to about 84%, from about 69% to about 80%; with the proviso that at least one of said polymers has a viscosity slope of greater than 6.5, from greater than 6.5 to about 100, from greater than 6.5 to about 50, or from greater than 6.5 to about 20;

iii. comprising a polymer produced by the process of inverse emulsion polymerization or solution polymerization; and/or iv. a polymer comprising a multi-dentate cross-linking agent; and at least one ethylenically unsaturated cationic monomer; with the proviso that at least 40%, at least 50%, at least 55% of said polymers' monomeric units are ethylenically unsaturated cationic monomer units and said polymer's overall net charge is cationic;

c) from about 0.05% to about 10%, from about 0.25% to about 10%, from about 0.3% to about 8%, from about 0.4% to about 7%, from about 0.5% to about 5% of a silicone polymer; and d) from about 1% to about 30%, from about 3% to about 25%, from about 5% to about 20%, from about 6% to about 15% of a fabric softener active, said composition being a fluid.

In one aspect of the present invention, said dialkyl quaternary ammonium compound is selected from the group consisting of:

a) a material having the structure:

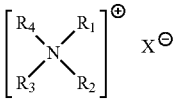

wherein each $R_1$ and $R_2$ are independently $C_6$ to $C_{12}$ hydrocarbyl chains;

$R_3$ and $R_4$ are each independently selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion;

b) a material having the structure:

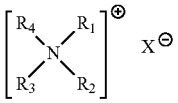

$R_1$ comprises a $C_{12}$ to $C_{22}$ hydrocarbyl chain, $R_2$ comprises a $C_6$ to $C_{12}$ hydrocarbyl chain, wherein $R_1$ has at least two more carbon atoms in the hydrocarbyl chain than $R_2$; $R_3$ and $R_4$ are each independently selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion;

c) a material having the structure:

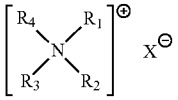

wherein $R_1$ comprises a $C_{12}$ to $C_{22}$ hydrocarbyl chain, $R_2$ and $R_3$ form a saturated or unsaturated ring containing 3-6 hydrocarbyl atoms and may be interrupted by N, O, or S, wherein $R_1$ has at least two more carbon atoms in the hydrocarbyl chain, and $R_4$ is absent when the ring is unsaturated at nitrogen or otherwise is selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion; and d) mixtures thereof.

In another aspect of the present invention, said dialkyl quaternary ammonium compound comprises a water-soluble dialkyl quaternary ammonium compound is selected from the group consisting of:

a) a material having the structure:

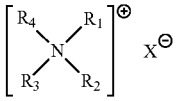

wherein each $R_1$ and $R_2$ are independently $C_8$ to $C_{10}$ hydrocarbyl chains;

$R_3$ and $R_4$ are each methyl; and $X^-$ is a halide or an organic sulphate;

b) a material having the structure

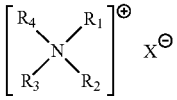

wherein $R_1$ is tallowyl and $R_2$ is 2-ethylhexyl, and $R_3$ and $R_4$ are methyl; and $X^-$ is a halide or an organic sulphate; and c) mixtures thereof.

In one aspect of the present invention, said polymeric material is selected from a polymeric material having:

a) a viscosity slope of from about 3.7 to about 6.5, from about 3.7 to about 6, from about 3.9 to about 6, from about 4 to about 5.5, from about 4 to about 4.2 and/or having a micro gel content of greater than 60%, greater than 65%, greater than 67%, greater than 69% or from about 60% to about 90%, from about 65% to about 90%, from about 67% to about 87%, from 69% to about 84%, from 69% to about 80%;

b) comprising a polymer produced by the process of inverse emulsion polymerization of dialkyl ammonium halides or compounds according to formula (I):

(I)

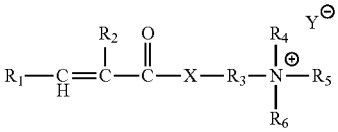

wherein:

$R_1$ is chosen from hydrogen or methyl, in one aspect $R_1$ is hydrogen;

$R_2$ is chosen hydrogen, or $C_1$-$C_4$ alkyl, in one aspect $R_2$ is chosen from hydrogen or methyl;

$R_3$ is chosen $C_1$-$C_4$ alkylene, in one aspect $R_3$ is ethylene;

$R_4$, $R_5$, and $R_6$ are each independently chosen from hydrogen, or $C_1$-$C_4$ alkyl, in one aspect $R_4$, $R_5$, and $R_6$ are methyl;

X is chosen from —O—, or —NH—, in one aspect X is —O—; and

Y is chosen from Cl, Br, I, hydrogensulfate or methosulfate, in one aspect Y is Cl.

The alkyl groups may be linear or branched. The alkyl groups are methyl, ethyl, propyl, butyl, and isopropyl.

and, optionally, monomers of formula (II) wherein (II)

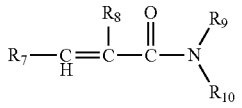

wherein:

$R_7$ is chosen from hydrogen or methyl, in one aspect $R_7$ is hydrogen;

$R_8$ is chosen from hydrogen or $C_1$-$C_4$ alkyl, in one aspect $R_8$ is hydrogen; $R_9$ and $R_{10}$ are each independently chosen from hydrogen or $C_1$-$C_4$ alkyl, in one aspect $R_9$ and $R_{10}$ are each independently chosen from hydrogen or methyl c) a polymer comprising a multi-dentate cross-linking agent selected from the group consisting of divinylbenzene, tetraallylammonium chloride, allyl acrylates, allyl methacrylates, diacrylates and dimethacrylates of glycols or polyglycols, butadiene, 1,7-octadiene, allylacrylamides or allylmethacrylamides, bisacrylamidoacetic acid, N,N'-methylenebisacrylamide or polyol polyallyl ethers such as polyallyl sucrose or pentaerythritol triallyl ether, dialkyldimethylammonium chloride, and/or mixtures thereof, and at least one ethylenically unsaturated cationic monomer selected from the group consisting of quaternized dimethylaminoethyl acrylate, quaternized dimethylaminoethyl methacrylate and mixtures thereof; in one aspect, said at least one ethylenically unsaturated cationic monomer is selected from the group consisting of 2-trimethylaminoethyl acrylate chloride, 2-trimethylaminoethyl methacrylate chloride and mixtures thereof; with the proviso that at least 40%, at least 50%, at least 55% of said polymers' monomeric units are ethylenically unsaturated cationic monomer units and said polymer's overall net charge is cationic.

In another aspect of the present invention, a composition containing said polymer wherein the monomers are dimethyl aminoethyl acrylate methyl chloride and acrylamide is disclosed.

In one aspect of the present invention, a composition comprising a silicone polymer wherein said silicone polymer is selected from the group consisting of polydimethylsiloxanes, aminosilicones, cationic silicones, silicone polyethers, silicone resins, and mixtures thereof is disclosed.

In one aspect, said silicone polymer has a structure selected from:

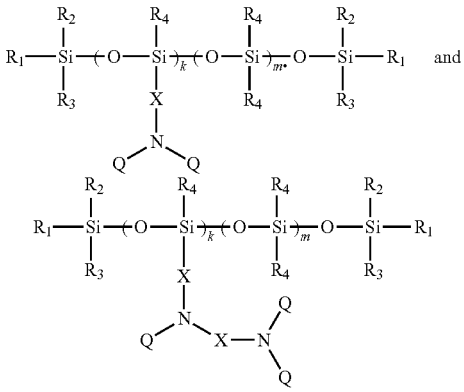

wherein:

k is an integer from 2 to about 100;

m is an integer from 4 to about 5,000;

each X is a substituted or unsubstituted divalent alkylene radical comprising 2-12 carbon atoms, in one aspect each divalent alkylene radical is independently selected from the group consisting of —$(CH_2)_s$- wherein s is an integer from about 2 to about 8, from about 2 to about 4; in one aspect, each X is group consisting of: —$CH_2$—CH(OH)—$CH_2$—; —$CH_2$—$CH_2$—CH(OH)— and

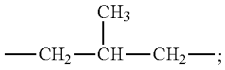

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, and $C_1$-$C_{32}$ substituted alkoxy;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

wherein at least one Q in said silicone polymer is independently selected from the group consisting of —$CH_2$—CH(OH)—$CH_2$—$R_5$;

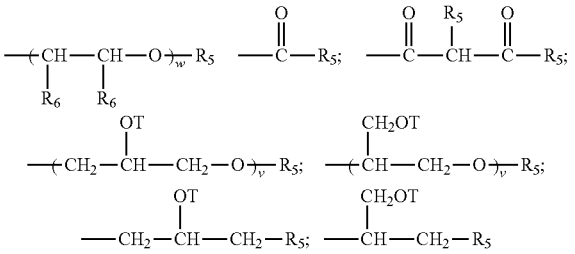

and each additional Q in said silicone polymer is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl; —$CH_2$—CH(OH)—$CH_2$—$R_5$;

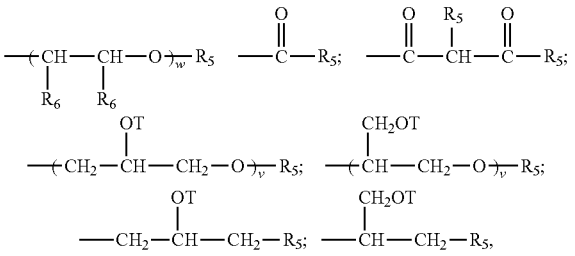

and w is an integer from 1 to about 10;

wherein each $R_5$ is independently selected from the group consisting of H, $C_1$-$C_{32}$ alkyl;

each $R_6$ is independently selected from H, $C_1$-$C_{18}$ alkyl;

each T moiety is independently selected from H, and

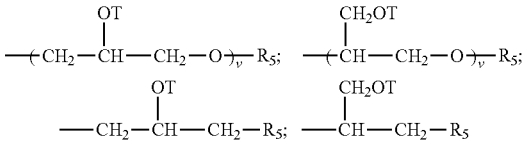

and when v is absent for a respective T moiety said T moiety is H, each v in said silicone polymer is an integer from 1 to about 10, and the sum of all v indices in each Q in the said silicone polymer is an integer from 1 to about 30.

In another aspect of the present invention, a composition comprising a silicone polymer wherein said silicone polymer has a structure selected from:

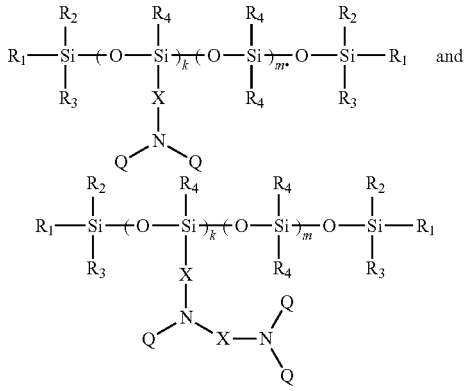

and wherein:

k is an integer from 2 to about 10;

m is an integer from 50 to about 500;

$R_1$, $R_2$ and $R_3$ are each independently selected from the group consisting of H, OH, $C_1$-$C_{32}$ alkyl, and $C_1$-$C_{32}$ alkoxy;

each $R_4$ is independently selected from the group consisting of H, OH, $C_1$-$C_{32}$ alkyl, and $C_1$-$C_{32}$ alkoxy;

wherein at least one Q in said silicone polymer is independently selected from the group consisting of

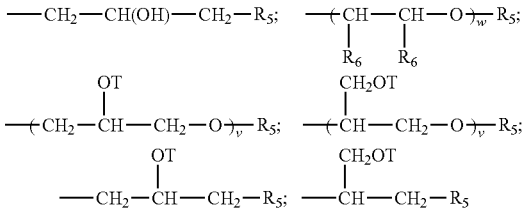

and each additional Q in said silicone polymer is independently selected from the group comprising of H, $C_1$-$C_{32}$ alkyl, $C_1$-$C_{32}$ substituted alkyl;

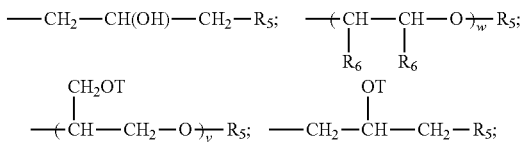

-continued

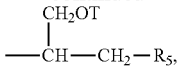

and w is an integer from 1 to about 10;

wherein each $R_5$ is independently selected from the group consisting of H, $C_1$-$C_{32}$ alkyl;

each $R_6$ is independently selected from H, $C_1$-$C_2$ alkyl;

each T moiety is independently selected from H, and

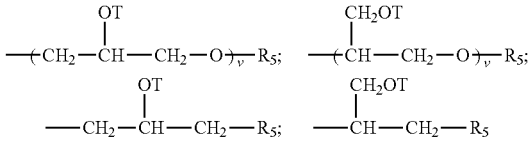

and when v is absent for a respective T moiety said T moiety is H, each v in said silicone polymer is an integer from 1 to about 5, and the sum of all v indices in each Q in the said silicone polymer is an integer from 1 to about 20. All other moieties and indices are as defined previously.

In one aspect of the present invention, a composition wherein said fabric softener active is selected from the group consisting of di-tail fabric softener actives, mono-tail fabric softener actives, ion pair fabric softener actives, sucrose ester-based fabric softening actives and mixtures thereof, said composition optionally comprising a softener active selected from the group consisting of amines, fatty esters, dispersible polyolefins, clays, polysaccharides, hydrophobic polysaccharides, imidazolines, fatty oils, polymer latexes and mixtures thereof.

In one aspect, said di-tail fabric softener active, mono-tail fabric softener active and ion pair fabric softener actives are selected from the group consisting of:

a) materials having Formula (1) below (Formula 1)

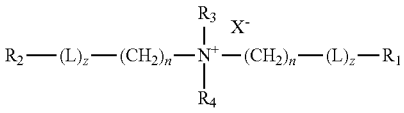

wherein:

(i) $R_1$ and $R_2$ are each independently a $C_5$-$C_{23}$ hydrocarbon;

(ii) $R_3$ and $R_4$ are each independently selected from the group consisting of $C_1$-$C_4$ hydrocarbon, $C_1$-$C_4$ hydroxy substituted hydrocarbon, benzyl, —$(C_2H_4O)_yH$ where y is an integer from 1 to 10;

(iii) L is selected from the group consisting of —C(O)O—, —$(CH_2CH_2O)_m$—, —C(O)—, —O—(O)C—, —NR—C(O)—, —C(O)—NR— wherein m is 1 or 2 and R is hydrogen or methyl;

(iv) each n is independently an integer from 0 to 4 with the proviso that when L is —O—(O)C— or —NR—C(O) the respective n is an integer from 1 to 4;

(v) each z is independently 0 or 1; and (vi) $X^-$ is a softener-compatible anion;

b) materials having Formula (2) below (Formula 2)

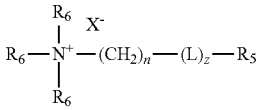

wherein (i) $R_5$ is a $C_5$-$C_{23}$ hydrocarbon;

(ii) each $R_6$ is independently selected from the group consisting of $C_1$-$C_4$ hydrocarbon, $C_1$-$C_4$ hydroxy substituted hydrocarbon, benzyl, —$(C_2H_4O)_yH$ where y is an integer from 1 to 10;

(iii) L is selected from the group consisting of —C(O)O—, —$(OCH_2CH_2)_m$— —$(CH_2CH_2O)_m$—, —C(O)—, —O—(O)C—, —NR—C(O)—, —C(O)—NR— wherein m is 1 or 2 and R is hydrogen or methyl;

(iv) each n is independently an integer from 0 to 4 with the proviso that when L is —O—(O)C— or —NR—C(O) the respective n is an integer from 1 to 4;

(v) z is 0 or 1; and (vi) $X^-$ is a softener-compatible anion;

c) materials having Formula (3) below (Formula 3)

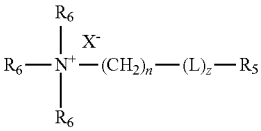

wherein (i) $R_5$ is a $C_5$-$C_{23}$ hydrocarbon;

(ii) each $R_6$ is independently selected from the group consisting of $C_1$-$C_4$ hydrocarbon, $C_1$-$C_4$ hydroxy substituted hydrocarbon, benzyl, —$(C_2H_4O)_yH$ where y is an integer from 1 to 10;

(iii) L is selected from the group consisting of —C(O)O—, —$(OCH_2CH_2)_m$— —$(CH_2CH_2O)_m$—, —C(O)—, —O—(O)C—, —NR—C(O)—, —C(O)—NR— wherein m is 1 or 2 and R is hydrogen or methyl;

(iv) each n is independently an integer from 0 to 4 with the proviso that when L is —O—(O)C— or —NR—C(O) the respective n is an integer from 1 to 4;

(v) z is 0 or 1; and (vi) $X^-$ is an anionic surfactant comprising a $C_6$-$C_{24}$ hydrocarbon.

In one aspect, said di-tail fabric softener active, mono-tail fabric softener active and ion pair fabric softener actives are selected from the group consisting of:

a) materials having Formula (1) below (Formula 1)

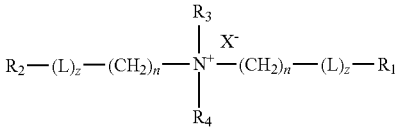

wherein:

(i) $R_1$ and $R_2$ are each independently a $C_{11}$-$C_{17}$ hydrocarbon;

(ii) $R_3$ and $R_4$ are each independently selected from the group consisting of $C_1$-$C_2$ hydrocarbon, $C_1$-$C_2$ hydroxy substituted hydrocarbon;

(iii) each n is independently an integer from 1 to 2;

(iv) L is selected from the group consisting of —C(O)O—, —C(O)—, —O—(O)C—;

(v) each z is independently 0 or 1; and (vi) X— is a softener-compatible anion, selected from the group consisting of halides, sulfonates, sulfates, and nitrates.

b) materials having Formula (2) below (Formula 2)

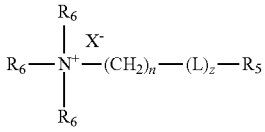

wherein (i) $R_5$ is a $C_{11}$-$C_{17}$ hydrocarbon;

(ii) each $R_6$ is independently selected from the group consisting of $C_1$-$C_2$ hydrocarbon, $C_1$-$C_2$ hydroxy substituted hydrocarbon;

(iii) n is an integer from 1 to 4;

(iv) L is selected from the group consisting of —C(O)O—, —C(O)—, —O—(O)C—;

(v) z is 0 or 1; and (vi) $X^-$ is a softener-compatible anion, selected from the group consisting of halides, sulfonates, sulfates, and nitrates;

c) materials having Formula (3) below (Formula 3)

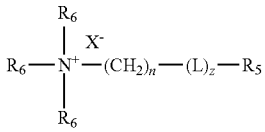

wherein (i) $R_5$ is a $C_5$-$C_{23}$ hydrocarbon;

(ii) each $R_6$ is independently selected from the group consisting of $C_1$-$C_4$ hydrocarbon, $C_1$-$C_4$ hydroxy substituted hydrocarbon, benzyl, —$(C_2H_4O)_yH$ where y is an integer from 1 to 10;

(iii) L is selected from the group consisting of —C(O)O—, —$(OCH_2CH_2)_m$— —$(CH_2CH_2O)_m$—, —C(O)—, —O—(O)C—, —NR—C(O)—, —C(O)—NR— wherein m is 1 or 2 and R is hydrogen or methyl;

(iv) each n is independently an integer from 0 to 4 with the proviso that when L is —O—(O)C— or —NR—C(O) the respective n is an integer from 1 to 4;

(v) z is 0 or 1; and (vi) X— is an anionic surfactant comprising a $C_6$-$C_{24}$ hydrocarbon.

In one aspect, said di-tail fabric softener active, mono-tail fabric softener active and ion pair fabric softener actives are selected from the group consisting of:

a) materials having Formula (1) below (Formula 1)

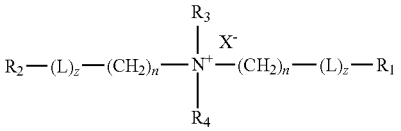

wherein:

(i) $R_1$ and $R_2$ are each independently a $C_{11}$-$C_{17}$ hydrocarbon;

(ii) $R_3$ and $R_4$ are each independently selected from the group consisting of $C_1$-$C_2$ hydrocarbon, $C_1$-$C_2$ hydroxy substituted hydrocarbon;

(iii) each n is independently an integer from 1 to 2;

(iv) L is selected from the group consisting of —C(O)O—, —C(O)—, —O—(O)C—;

(v) each z is independently 0 or 1; and (vi) $X^-$ is a softener-compatible anion, selected from the group consisting of chloride, bromide, methylsulfate, ethylsulfate, and methyl sulfonate.

b) materials having Formula (2) below (Formula 2)

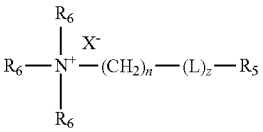

wherein (i) $R_5$ is a $C_{11}$-$C_{17}$ hydrocarbon;

(ii) each $R_6$ is independently selected from the group consisting of $C_1$-$C_2$ hydrocarbon, $C_1$-$C_2$ hydroxy substituted hydrocarbon;

(iii) n is an integer from 1 to 4;

(iv) L is selected from the group consisting of —C(O)O—, —C(O)—, —O—(O)C—;

(v) z is 0 or 1; and (vi) X— is a softener-compatible anion, selected from the group consisting of chloride, bromide, methylsulfate, ethylsulfate, and methyl sulfonate or anionic surfactant comprising a $C_6$-$C_{18}$ hydrocarbon c) materials having Formula (3) below (Formula 3)

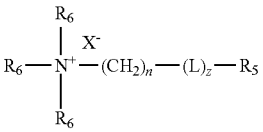

wherein (i) $R_5$ is a $C_{11}$-$C_{17}$ hydrocarbon;

(ii) each $R_6$ is independently selected from the group consisting of $C_1$-$C_2$ hydrocarbon, $C_1$-$C_2$ hydroxy substituted hydrocarbon;

(iii) n is an integer from 1 to 4;

(iv) L is selected from the group consisting of —C(O)O—, —C(O)—, —O—(O)C—;

(v) z is 0 or 1; and (vi) X— is a softener-compatible anion, selected from the group consisting of chloride, bromide, methylsulfate, ethylsulfate, and methyl sulfonate or anionic surfactant comprising a $C_6$-$C_{18}$ hydrocarbon.

In one aspect, for Formula 2, X— is a $C_6$-$C_{24}$ hydrocarbon that is an anionic surfactant.

In one aspect, said fabric care active comprises a fabric softening active selected from the group consisting of N,N-di(hydrogenated tallowoyloxyethyl)-N,N-dimethylammonium chloride; N,N-di(tallowoyloxyethyl)-N,N-dimethylammonium chloride; di-hydrogenated tallow dimethyl ammonium chloride; ditallowedimethyl ammonium chloride; and mixtures thereof.

In one aspect of the present invention, a composition having an initial finished product viscosity of 20-500 cps or 30-400 cps.; having a silicone deposition efficiency index of from about 6% to about 90%, from about 7% to about 60%, from about 9% to about 40%, from about 10% to about 30%, and a stability index of less than 10% separation, less than 5% separation, less than 2% separation after 12 weeks at 35° C. is disclosed.

Process of Making Polymer

In one aspect, a method of making a polymer having a chain transfer agent (CTA) value in a range greater than 1000 ppm by weight of component a). Another aspect of the invention is directed to providing a polymer having a cross linker greater than 5 ppm, alternatively greater than 45 ppm, by weight of component a). Without wishing to be bound by theory, it is believed that a polymer comprising a high level of CTA and/or high level of cross linker can surprisingly provide a fabric care composition having surprisingly superior softener active and/or perfume deposition.

The polymer, in one aspect, comprises from 0.001% to 10% by weight of the fabric care composition. In alternative aspects, the polymer comprises from 0.01% to 0.3%, alternatively from 0.05% to 0.25%, alternatively from 0.1% to 0.20%, alternatively combinations thereof, of the polymer by weight of the fabric care composition.

In one aspect of the invention, the component a) comprises 5-95% by weight (wt-%) of at least one cationic monomer and 5-95 wt-% of at least one non-ionic monomer. The weight percentages relate to the total weight of the copolymer.

In yet still another aspect of the invention, the component a) comprises 50-70 wt-%, or 55-65 wt-%, of at least one cationic monomer and 30-50 wt-%, or 35-45 wt-%, of at least one non-ionic monomer. The weight percentages relate to the total weight of the copolymer.

Cationic Monomers

Suitable cationic monomers include dialkyl ammonium halides or compounds according to formula (I):

(I)

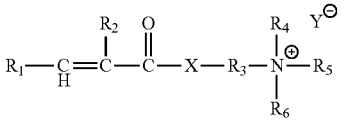

wherein:

$R_1$ is chosen from hydrogen or methyl, in one aspect, $R_1$ is hydrogen;

$R_2$ is chosen hydrogen, or $C_1$-$C_4$ alkyl, in one aspect, $R_2$ is hydrogen or methyl;

$R_3$ is chosen $C_1$-$C_4$ alkylene, in one aspect, $R_3$ is ethylene;

$R_4$, $R_5$, and $R_6$ are each independently chosen from hydrogen, or $C_1$-$C_4$ alkyl, in one aspect, $R_4$, $R_5$, and $R_6$ are methyl;

X is chosen from —O—, or —NH—, in one aspect, X is —O—; and

Y is chosen from Cl, Br, I, hydrogensulfate or methosulfate, in one aspect, Y is Cl.

The alkyl groups may be linear or branched. The alkyl groups are methyl, ethyl, propyl, butyl, and isopropyl.

In one aspect, the cationic monomer of formula (I) is dimethyl aminoethyl acrylate methyl chloride.

Non-Ionic Monomers

Suitable non-ionic monomers include compounds of formula (II) wherein (II)

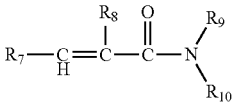

wherein:

$R_7$ is chosen from hydrogen or methyl; in one aspect, $R_7$ is hydrogen;

$R_8$ is chosen from hydrogen or $C_1$-$C_4$ alkyl; in one aspect $R_8$ is hydrogen; and $R_9$ and $R_{10}$ are each independently chosen from hydrogen or $C_1$-$C_4$ alkyl; in one aspect, $R_9$ and $R_{10}$ are each independently chosen from hydrogen or methyl.

In one aspect, the non-ionic monomer is acrylamide.

Cross-Linking Agent

The cross-linking agent b) contains at least two ethylenically unsaturated moieties. In one aspect, the cross-linking agent b) contains at least three or more ethylenically unsaturated moieties; in one aspect, the cross-linking agent b) contains at least four or more ethylenically unsaturated moieties.

Suitable cross-linking agents include divinyl benzene, tetraallyl ammonium chloride, allyl acrylates and methacrylates, diacrylates and dimethacrylates of glycols and polyglycols, butadiene, 1,7-octadiene, allyl-acrylamides and allyl-methacrylamides, bisacrylamidoacetic acid, N,N'-methylene-bisacrylamide and polyol polyallylethers, such as polyallylsaccharose and pentaerythrol triallylether, and mixtures thereof. In one aspect, the cross-linking agents are chosen from tetraallyl ammonium chloride, allyl-acrylamides and allyl-methacrylamides, bisacrylamidoacetic acid, and N,N'-methylene-bisacrylamide, and mixtures thereof. In one aspect, the cross-linking agent is tetraallyl ammonium chloride.

It is also suitable to use mixtures of cross-linking agents. The crosslinker(s) is (are) included in the range of from about 0.5 ppm to about 500 ppm, alternatively from about 10 ppm to about 400 ppm; alternatively from about 20 ppm to about 200 ppm, alternatively from about 40 ppm to about 100 ppm, alternatively from about 50 ppm to about 80 ppm (based upon the component a). In one aspect, the cross linker is greater than about 5 ppm (based on component a).

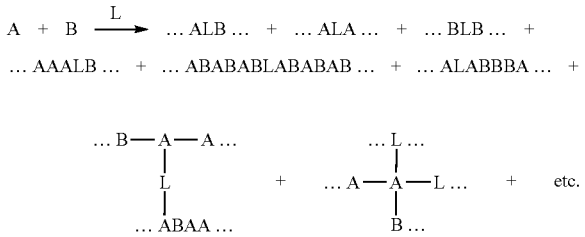

Chain Transfer Agent (CTA)

The chain transfer agent c) includes mercaptans, malic acid, lactic acid, formic acid, isopropanol and hypophosphites, and mixtures thereof. In one aspect, the CTA is formic acid.

The CTA is present in a range greater than about 100 ppm (based on component a). In one aspect, the CTA is from about 100 ppm to about 10,000 ppm, alternatively from about 500 ppm to about 4,000 ppm, alternatively from about 1,000 ppm to about 3,500 ppm, alternatively from about 1,500 ppm to about 3,000 ppm, alternatively from about 1,500 ppm to about 2,500 ppm, alternatively combinations thereof (based on component a). In yet another aspect, the CTA is greater than about 1000 (based on component a). It is also suitable to use mixtures of chain transfer agents.

Molecular Weight Range

In one aspect, the polymer comprises a Number Average Molecular Weight (Mn) from about 1,000,000 Daltons to about 3,000,000 Daltons, alternatively from about 1,500,000 Daltons to about 2,500,000 Daltons.

In another aspect, the polymer comprises a Weight Average Molecular Weight (Mw) from about 4,000,000 Daltons to about 11,000,000 Daltons, alternatively from about 4,000,000 Daltons to about 6,000,00 Daltons.

One example of the present invention is the inverse emulsion polymerization of acrylamide and DMA3 in the presence of a cross-linker and chain transfer agent to produce a polymer mixture wherein the micro-gel colloidal glass has a particle content as measured by ultracentrifugation of 69%. The remaining polymer portion of the composition is a mixture of linear and/or slightly branched polymers.

Stabilizing Agents for Polymer Synthesis and Examples

Stabilizing agent A (nonionic block copolymer): Polyglyceryl-dipolyhydroxystearate with CAS-Nr. 144470-58-6

Stabilizing agent B is a nonionic ABA-block copolymer with molecular weight of about 5000 g/mol, and a hydrophobic lipophilic balance value (HLB) of 5 to 6, wherein the A block is based on polyhydroxystearic acid and the B block on polyalkylene oxide.

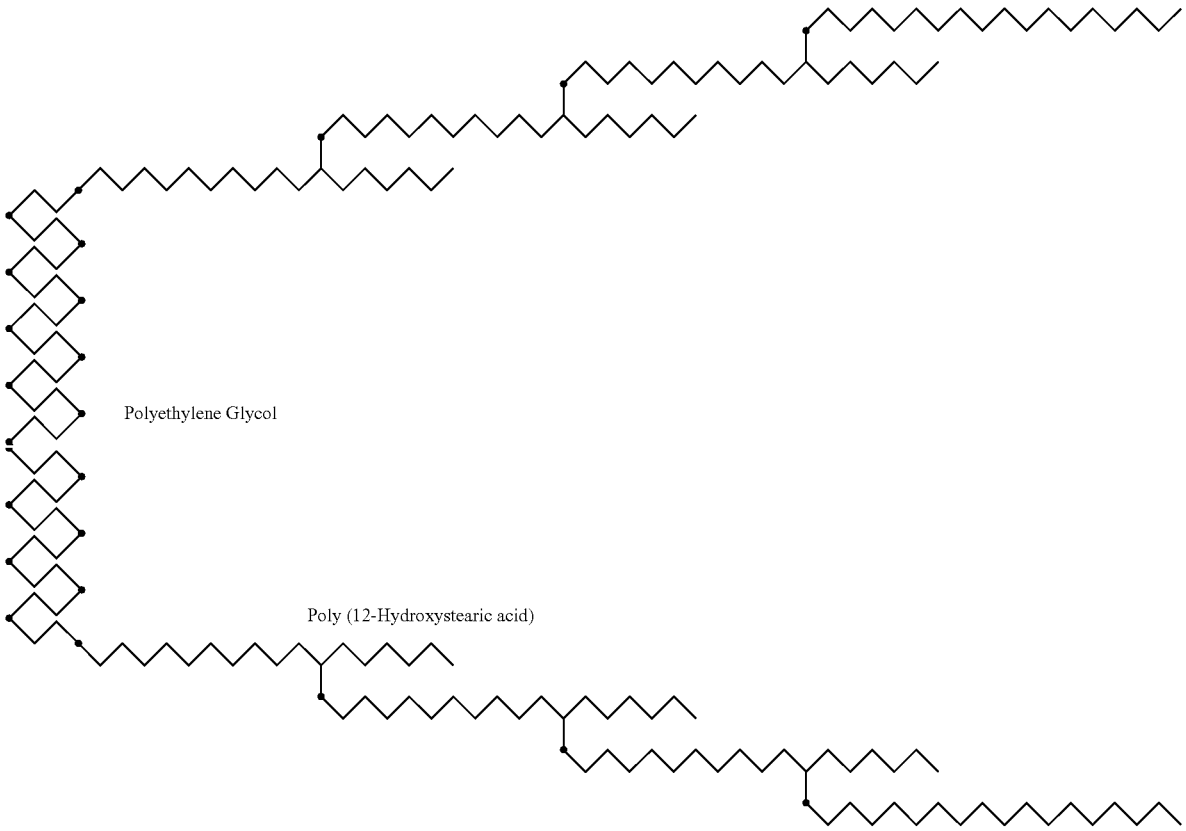
Stabilizing agent C (nonionic block copolymer): PEG-30 Dipolyhydroxystearate, with CAS-Nr. 70142-34-6
Stabilizing agent D (nonionic block copolymer): Alcyd Polyethylenglycol Poly-isobutene stabilizing surfactant with HLB 5-7
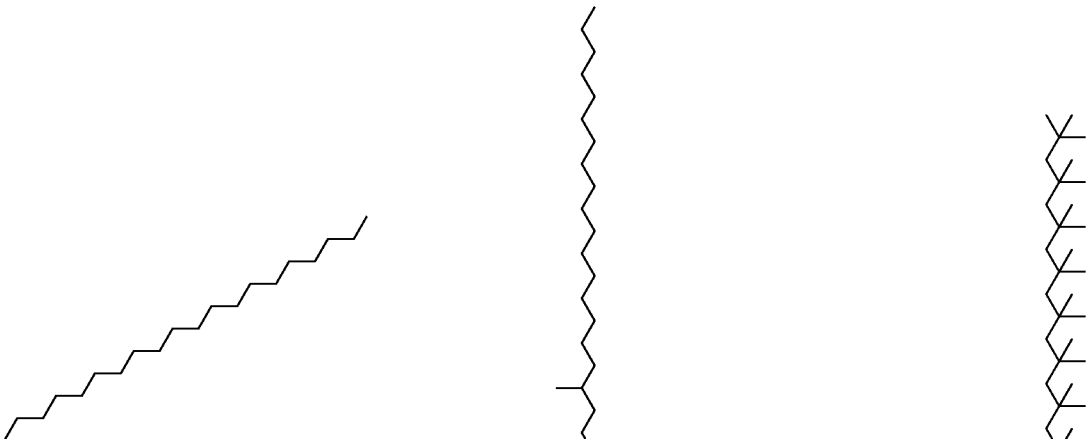

-continued

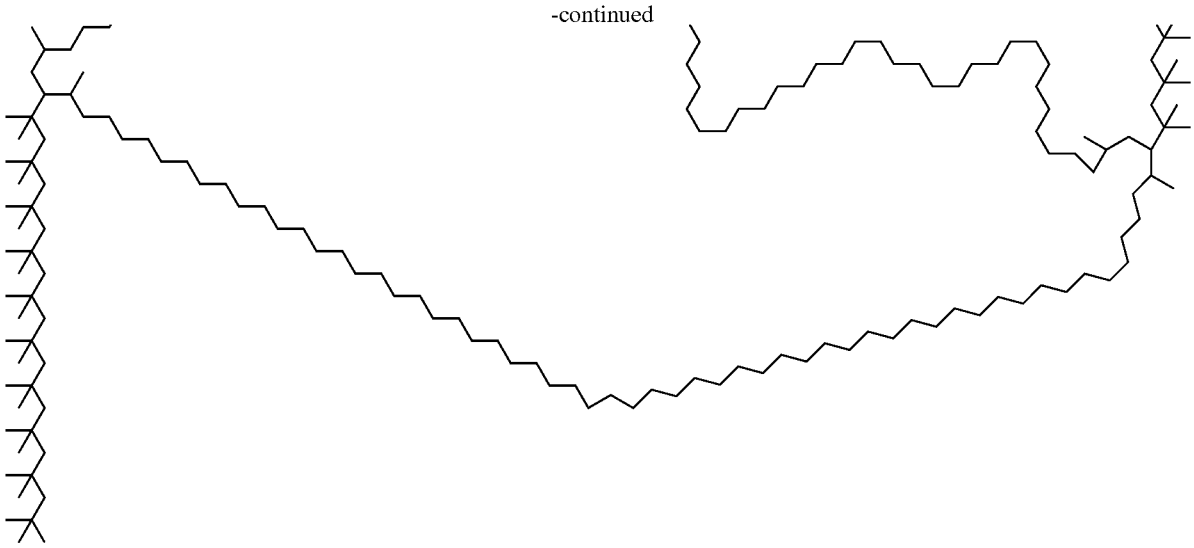

Oil soluble group:poly-iso-butylene
Anchoring group:polyethylene glycol

Adjunct Materials

While not essential for the purposes of the present invention, the non-limiting list of adjuncts illustrated hereinafter are suitable for use in the instant compositions and may be desirably incorporated in certain aspects of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the fabric treatment operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, structurants, hydrotropes, processing aids, solvents and/or pigments. In addition to the disclosure below, suitable examples of such other adjuncts and levels of use are found in U.S. Pat. Nos. 5,576,282, 6,306,812 B1 and 6,326,348 B1 that are incorporated by reference.

As stated, the adjunct ingredients are not essential to Applicants' compositions. Thus, certain aspects of Applicants' compositions do not contain one or more of the following adjuncts materials: surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removaVanti-redeposition agents, brighteners, suds suppressors, dyes, perfumes, structure elasticizing agents, fabric softeners, carriers, hydrotropes, processing aids, solvents and/or pigments. However, when one or more adjuncts are present, such one or more adjuncts may be present as detailed below:

Surfactants—The compositions according to the present invention may comprise a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof.

The surfactant is typically present at a level of from about 0.1% to about 60%, from about 1% to about 50% or even from about 5% to about 40% by weight of the subject composition.

Chelating Agents—The compositions herein may contain a chelating agent. Suitable chelating agents include copper, iron and/or manganese chelating agents and mixtures thereof.

When a chelating agent is used, the composition may comprise from about 0.1% to about 15% or even from about 3.0% to about 10% chelating agent by weight of the subject composition.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

When present in a subject composition, the dye transfer inhibiting agents may be present at levels from about 0.0001% to about 10%, from about 0.01% to about 5% or even from about 0.1% to about 3% by weight of the composition.

Dispersants—The compositions of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Perfumes—The dispersed phase may comprise a perfume that may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl)propyl]cyclopentan-2-one, 2-sec-butylcyclohexanone, and β-dihydro ionone, linalool, ethyllinalool, tetrahydrolinalool, and dihydromyrcenol.

Encapsulates—The dispersed phase may comprise encapsulates. Suitable encapsulates include perfume microcapsules comprising a shell that encapsulates a core. Said core comprising one or more benefits agent. Said benefit agent may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl)propyl]cyclopentan-2-one, 2-sec-butylcyclohexanone, and β-dihydro ionone, linalool, ethyllinalool, tetrahydrolinalool, and dihydromyrcenol; silicone oils, waxes such as polyethylene waxes; essential oils such as fish oils, jasmine, camphor, lavender; skin coolants such as menthol, methyl lactate; vitamins such as Vitamin A and E; sunscreens; glycerine; catalysts such as manganese catalysts or bleach catalysts; bleach particles such as perborates; silicon dioxide particles; antiperspirant actives; cationic polymers and mixtures thereof. Suitable benefit agents can be obtained from Givaudan Corp. of Mount Olive, N.J., USA, International Flavors & Fragrances Corp. of South Brunswick, N.J., USA, or Quest Corp. of Naarden, Netherlands. Said shell may comprise materials selected from the group consisting of reaction products of one or more amines with one or more aldehydes, such as urea cross-linked with formaldehyde or gluteraldehyde, melamine cross-linked with formaldehyde; gelatin-polyphosphate coacervates optionally cross-linked with gluteraldehyde; gelatin-gum Arabic coacervates; cross-linked silicone fluids; polyamine reacted with polyisocyanates, acrylates and mixtures thereof.

In one aspect, said encapsulate may comprise a coating that encapsulates said shell. Said coating providing additional benefits that may include enhancing the deposition characteristics of the encapsulate and/or the encapsulate's benefit agent. In one aspect, said coating may comprise one or more efficiency polymers selected from the group consisting of polyvinyl amines, polyvinyl formamides, and polyallyl amines and copolymers thereof. In one aspect, said encapsulate may be a perfume microcapsule that has a shell comprising melamine formaldehyde and/or an acrylate and a core that comprises perfume. Said perfume microcapsule may comprise an optional coating listed above.

Processes of Making Products

A process of making a composition of the present invention comprising adding a combination of silicone polymer and dialkyl quaternary compound to a softener active that is dispersed in a solvent. The compositions of the present invention can be formulated into any suitable form and prepared by any process chosen by the formulator, non-limiting examples of which are described in Applicants examples and in USPA 2010/0020632A1 and USPA 2011/0172137A1; U.S. Pat. Nos. 5,879,584; 5,691,297; 5,574,005; 5,569,645; 5,565,422; 5,516,448; 5,489,392; and 5,486,303 all of which are incorporated herein by reference.

In one aspect, the compositions disclosed herein may be prepared by combining the components thereof in any convenient order and by mixing, e.g., agitating, the resulting component combination to form a phase stable cleaning composition. In one aspect, a fluid matrix may be formed containing at least a major proportion, or even substantially all, of the fluid components with the fluid components being thoroughly admixed by imparting shear agitation to this liquid combination. For example, rapid stifling with a mechanical stirrer may be employed.

Method of Use

The compositions of the present invention may be used in any conventional manner. In short, they may be used in the same manner as products that are designed and produced by conventional methods and processes. For example, compositions of the present invention can be used to clean and/or treat a situs inter alia a surface or fabric. Typically at least a portion of the situs is contacted with an aspect of Applicants' composition, in neat form or diluted in a wash liquor, and then the situs is optionally washed and/or rinsed. For purposes of the present invention, washing includes but is not limited to, scrubbing, and mechanical agitation. The fabric may comprise any fabric capable of being laundered in normal consumer use conditions. When the wash solvent is water, the water temperature typically ranges from about 5° C. to about 90° C. and, when the situs comprises a fabric, the water to fabric mass ratio is typically from about 1:1 to about 100:1.

The consumer products of the present invention may be used as liquid fabric enhancers wherein they are applied to a fabric and the fabric is then dried via line drying and/or drying the an automatic dryer.

Test Methods

Determination of the Soluble and Insoluble Parts of the Polymer Using the Analytical Ultracentrifuge (AUC)

For the determination of soluble and insoluble parts of the polymer, fractionation experiments using Analytical ultracentrifugation are performed. Sedimentation velocity runs using a Beckman Optima XL-I (Beckman Instruments, Palo Alto, USA) with interference optical detection system (wavelength 675 nm) is used. The samples are measured at polymer concentrations below critical polymer overlap concentration using salt solution to insure polyelectrolyte screening effect. The centrifugation speed is varied between 1000 rpm and 45,000 rpm.

The distribution of sedimentation coefficients, defined as the weight fraction of species with a sedimentation coefficient between s and s+ds, and the concentration of one sedimenting fraction is determined using a standard analysis Software (SEDFIT). The change of the whole radial concentration profile with time is recorded and converted in distributions of sedimentation coefficient g(s) using the density and viscosity of the solvent, and a specific refractive index increment of the polymer. The sedimentation coefficient is in units of Sved ($1\text{Sved}=10^{-13}$ seconds).

Assessing Phase and Brookfield Viscosity and Stability

Brookfield viscosity is measured using a Brookfield DV-E viscometer fitted with a LV2 spindle at 60 RPM. The test is conducted in accordance with the instrument's instructions. Initial viscosity is defined as the Brookfield viscosity measured within 24 hours of making the finished product sample. Samples are stored in glass jars with a screw cap lid and aged undisturbed in a constant temperature room maintained at 35° C.

Physical stability is assessed by visual observation of the product in the undisturbed glass jar. Products are deemed stable when no clear layer is observed at the bottom of the jar. Products are deemed unstable when a clear layer is observed at the bottom of the jar. The extent of stability can be measured as a percentage of phase separation of the separated layer(s) with respect to the entire formulation. Brookfield viscosity of the aged sample is measured after tipping the jar by hand to homogenize the sample.

Determining Viscosity Slope

Acidified water is prepared gravimetrically by adding about 0.1 ppm hydrochloric acid to deionized water. A series of aqueous polymer solutions is prepared to logarithmically span between 0.01 and 1 polymer weight percent of the polymer in said acidic water. Each polymer solvent solution is prepared gravimetrically by mixing the polymer and solvent with a SpeedMixer™ DAC 150 FVZ-K (made by FlackTek Inc. of Landrum, S.C.) for 1 minute at 2,500 rpm in a Max 60 cup or Max 100 cup to the target polymer weight percent of the aqueous polymer solution. Viscosity as a function of shear rate of each polymer solvent solution is measured at 40 different shear rates using an Anton Paar rheometer with a DSR 301 measuring head and concentric cylinder geometry. The time differential for each measurement is logarithmic over the range of 180 and 10 seconds and the shear rate range for the measurements is 0.001 to 500 l/s (measurements taken from the low shear rate to the high shear rate).

Viscosities, for example at 0.2 Pa s and greater, at a shear rate of 0.01 l/s as a function of polymer weight percent of the aqueous polymer solvent solution are fit using the equation $Y=bX^a$ wherein X is the polymer concentration in the solvent polymer solution, Y is the polymer solvent solution viscosity, b is the extrapolated solvent polymer solution viscosity when X is extrapolated to one weight percent and the exponent a is the polymer concentration viscosity scaling power, here defined as the viscosity slope, over the polymer concentration range where the exponent a is the highest value. The range of viscosities fit with the equation and the resulting fit parameters are listed in Table 1.

Fabric and Test Swatch Preparation Method

Fabrics are assessed using Kenmore FS 600 and/or 80 series washer machines. Wash Machines are set at: 32° C./15° C. wash/rinse temperature, 6 gpg hardness, normal cycle, and medium load (64 liters). Fabric bundles consist of 2.5 kilograms of clean fabric consisting of 100% cotton. Test swatches are included with this bundle and comprise of 100% cotton Euro Touch terrycloth towels (purchased from Standard Textile, Inc. Cincinnati, Ohio). Prior to treatment with any test products, the fabric bundles are stripped according to the Fabric Preparation-Stripping and Desizing procedure before running the test. Tide Free liquid detergent (1× recommended dose) is added under the surface of the water after the machine is at least half full. Once the water stops flowing and the washer begins to agitate, the clean fabric bundle is added. When the machine is almost full with rinse water, and before agitation has begun, the fabric care testing composition is slowly added (1× dose), ensuring that none of the fabric care testing composition comes in direct contact with the test swatches or fabric bundle. When the wash/rinse cycle is complete, each wet fabric bundle is transferred to a corresponding dryer. The dryer used is a Maytag commercial series (or equivalent) electric dryer, with the timer set for 55 minutes on the cotton/high heat/timed dry setting. This process is repeated fro a total of three (3) complete wash-dry cycles. After the third drying cycle and once the dryer stops, 12 Terry towels from each fabric bundle are removed for actives deposition analysis. The fabrics are then placed in a constant Temperature/Relative Humidity (21° C., 50% relative humidity) controlled grading room for 12-24 hours and then graded for softness and/or actives deposition.

The Fabric Preparation-Stripping and Desizing procedure includes washing the clean fabric bundle (2.5 Kg of fabric comprising 100% cotton) including the test swatches of 100% cotton EuroTouch terrycloth towels for 5 consecutive wash cycles followed by a drying cycle. AATCC (American Association of Textile Chemists and Colorists) High Efficiency (HE) liquid detergent is used to strip/de-size the test swatch fabrics and clean fabric bundle (lx recommended dose per wash cycle). The wash conditions are as follows: Kenmore FS 600 and/or 80 series wash machines (or equivalent), set at: 48° C./48° C. wash/rinse temperature, water hardness equal to 0 gpg, normal wash cycle, and medium sized load (64 liters). The dryer timer is set for 55 minutes on the cotton/high/timed dry setting.

Silicone Measurement Method

Silicone is extracted from approximately 0.5 grams of fabric (previously treated according to the test swatch treatment procedure) with 12 mL of either 50:50 toluene:methylisobutyl ketone or 15:85 ethanol:methylisobutyl ketone in 20 mL scintillation vials. The vials are agitated on a pulsed vortexer for 30 minutes. The silicone in the extract is quantified using inductively coupled plasma optical emission spectrometry (ICP-OES). ICP calibration standards of known silicone concentration are made using the same or a structurally comparable type of silicone raw material as the products being tested. The working range of the method is 8-2300 μg silicone per gram of fabric. Concentrations greater than 2300 μg silicone per gram of fabric can be assessed by subsequent dilution. Deposition efficiency index of silicone is determined by calculating as a percentage, how much silicone is recovered, via the aforementioned extraction and measurement technique, versus how much is delivered via the formulation examples. The analysis is performed on terrycloth towels (EuroSoft towel, sourced from Standard Textile, Inc, Cincinnati, Ohio) that are treated according to the wash procedure outlined herein.

Example 1

(Comparative Example) Synthesis of cationic polymer (CE1)

An aqueous phase of water soluble components is prepared by admixing together the following components:

- 1.23 g of citric acid-1-hydrate,
- 0.7 g of a aqueous solution of pentasodium diethylenetriaminepentaacetate,
- 43.78 g of water,
- 29.56 g of methylene-bis-acrylamide (1% aqueous solution),
- 8 g of tetraallyammonium chloride (TAAC, 5% aqueous solution)
- 8.0 g of sodium hypophosphite (5% aqueous solution), and
- 326.66 g of methyl chloride quaternised dimethylaminoethylmethacrylate.

An oil phase is prepared by admixing together the following components:

- 8.0 g of sorbitan tri-oleate (75% in dearomatized aliphatic hydrocarbon) point between 160° C. to 190° C.
- 67.8 g of a polymeric stabilizer (stearyl methacrylate-methacrylic acid copolymer, 18.87% in solvent)
- 151.2 g of 2-ethylhexyl stearate, and
- 60.2 g of dearomatised hydrocarbon solvent with a boiling point between 160° C. to 190° C.

The two phases are mixed together in a ratio of 41.8 parts oil phase to 58.2 parts aqueous phase under high shear to form a water-in-oil emulsion. The resulting water-in-oil emulsion is transferred to a reactor equipped with nitrogen sparge tube, stirrer and thermometer. The emulsion is purged with nitrogen to remove oxygen.

Polymerisation is effected by addition of a redox couple of sodium metabisulphite and tertiary butyl hydroperoxide stepwise such that is a temperature increase of 2° C./min. Once the isotherm has been attained, a free radical initiator (2,2'-azobis(2-methylbutyronitrile), CAS: 13472-08-7) is added in two steps (the 2nd step after 45 min) and the emulsion is kept at 85° C. for 75 minutes.

Vacuum distillation is carried out to remove water and volatile solvent to give a final product of 50% polymer solids. To this product addition is made of 34.3 g of a fatty alcohol alkoxylate [alcohol C6-C17(secondary) poly(3-6)ethoxylate: 97% secondary alcohol ethoxylate+3% poly(ethylene oxide)], (CAS No. 84133-50-6).

Example 2

(Comparative Example) Synthesis of Cationic Polymer (CE2)

An aqueous phase of water soluble components is prepared by admixing together the following components:

1.88 g of citric acid-1-hydrate,
1.07 g of a aqueous solution of pentasodium diethylenetriaminepentaacetate,
220.37 g of water,
3.75 g of methylene-bis-acrylamide (1% aqueous solution),
0.75 g of formic acid
281.25 g of methyl chloride quaternised dimethylaminoethylacrylate (DMA3*MeCl80% aqueous solution), and
300.00 g of acrylamide (50% aqueous solution).

An oil phase is prepared by admixing together the following components:

12.245 g of sorbitan tri-oleate (75% in dearomatized aliphatic hydrocarbon) point between 160° C. to 190° C.
103.825 g of a polymeric stabiliser, stearyl methacrylate-methacrylic acid copolymer (18.87% in solvent)
259.14 g of 2-ethylhexyl stearate, and
99.97 g of dearomatised hydrocarbon solvent with a boiling point between 160° C. to 190° C.

The two phases are mixed together in a ratio of 37 parts oil phase to 63 parts aqueous phase under high shear to form a water-in-oil emulsion. The resulting water-in-oil emulsion is transferred to a reactor equipped with nitrogen sparge tube, stirrer and thermometer. 0.21 g Wako V59 is added and the emulsion is purged with nitrogen to remove oxygen.

Polymerisation is effected by addition of a redox couple of sodium metabisulphite and tertiary butyl hydroperoxide stepwise such that is a temperature increase of 2° C./min. After the isotherm is completed the emulsion held at 85° C. for 60 minutes. Then residual monomer reduction with 72.7 g tertiary butyl hydroperoxide (1.29% in solvent) and 82.2 g sodium metabisulphite (1.14% in emulsion) is started (3 hours feeding time).

Vacuum distillation is carried out to remove water and volatile solvent to give a final product, i.e. a dispersion containing 50% polymer solids. To this product addition is made of 52.5 g of Tergitol 15-S-7 (secondary alcohol ethoxylated).

Example 3

Synthesis of Cationic Polymer

An aqueous phase of water soluble components is prepared by admixing together the following components:

1.88 g of citric acid-1-hydrate,
1.07 g of a aqueous solution of pentasodium diethylenetriaminepentaacetate,
220.37 g of water,
3.75 g of methylene-bis-acrylamide (1% aqueous solution),
0.75 g of formic acid
281.25 g of methyl chloride quaternised dimethylaminoethylacrylate (DMA3*MeCl80% aqueous solution), and
300.00 g of acrylamide (50% aqueous solution).

An oil phase is prepared by admixing together the following components:

45.92 g of stabilizing agent B (20% in solvent) as stabilizing surfactant,
103.825 g of a polymeric stabiliser stearyl methacrylate-methacrylic acid copolymer (18.87% in solvent),
295.13 g of 2-ethylhexyl stearate, and
30.3 g of dearomatised hydrocarbon solvent with a boiling point between 160° C. to 190° C.

The two phases are mixed together in a ratio of 37 parts oil phase to 63 parts aqueous phase under high shear to form a water-in-oil emulsion. The resulting water-in-oil emulsion is transferred to a reactor equipped with nitrogen sparge tube, stirrer and thermometer. 0.38 g Wako V59 is added and the emulsion is purged with nitrogen to remove oxygen.

Polymerisation is effected by addition of a redox couple of sodium metabisulphite and tertiary butyl hydroperoxide stepwise such that is a temperature increase of 2° C./min. After the isotherm is completed the emulsion held at 85° C. for 60 minutes. Then residual monomer reduction with 72.7 g tertiary butyl hydroperoxide (1.29% in solvent) and 82.2 g sodium metabisulphite (1.14% in emulsion) is started (3 hours feeding time).

Vacuum distillation is carried out to remove water and volatile solvent to give a final product, i.e. a dispersion containing 50% polymer solids. To this product addition is made of 52.5 g of a fatty alcohol alkoxylate [alcohol C6-C17(secondary) poly(3-6)ethoxylate: 97% secondary alcohol ethoxylate+3% poly(ethylene oxide)], (CAS No. 84133-50-6).

Data

TABLE 1

Viscosities and fitted viscosity slope of Polymers P1-P5
Viscosities and Fitted Viscosity Slope of Polymers

| | Polymer | | | | | | | |
|---|---|---|---|---|---|---|---|---|
| | P1 | | P2 | | P3 | | P4 | |
| | wt. % | Visc. (Pa s) | wt. % | Visc. (Pa s) | wt. % | Visc. (Pa s) | wt. % | Visc. (Pa s) |
| | 0.13 | 0.295 | 0.13 | 1.91 | 0.09 | 0.76 | 0.16 | 0.50 |
| | 0.16 | 0.326 | 0.16 | 11.4 | 0.13 | 2.93 | 0.25 | 6.31 |
| | 0.20 | 0.348 | 0.20 | 25.0 | 0.16 | 4.65 | 0.40 | 71.2 |
| b [Pa s/wt. %$^a$] | 3.25 | | 4.55E+16 | | 7.16E+16 | | 5.97E+14 | |
| a (Visc. Slope) | 0.36 | | 5.6 | | 3.3 | | 5.4 | |

TABLE 1-continued

Viscosities and fitted viscosity slope of Polymers P1-P5
Viscosities and Fitted Viscosity Slope of Polymers

| | Polymer | | | | | | | |
|---|---|---|---|---|---|---|---|---|
| | P5 | | Comparative polymer 1 (CP1)[a] | | Comparative polymer 2 (CP2)[b] | | Comparative polymer 3 (CP3)[c] | |
| | wt. % | Visc. (Pa s) | wt. % | Visc. (Pa s) | wt. % | Visc. (Pa s) | wt. % | Visc. (Pa s) |
| | 0.25% | 0.093 | 0.06 | 0.21 | 0.06 | 0.013 | 0.06 | 0.001 |
| | 0.63% | 0.153 | 0.10 | 0.70 | 0.10 | 0.591 | 0.10 | 0.438 |
| | 1.00% | 0.186 | 0.16 | 2.02 | 0.16 | 3.58 | 0.16 | 11.0 |
| b [Pa s/wt. %[a]] | 1.99 | | 5.80E+6 | | 3.80E+5 | | 2.14E+9 | |
| a (Visc. Slope) | 0.51 | | 2.3 | | 6.1 | | 10.1 | |

[a]Cationic polymer available from BASF, SE, Ludwigshafen under the trade name Sedipur ® CL 544.
[b]Cationic polymer available from BASF, SE, Ludwigshafen under the trade name Rheovis ® CDE.
[c]Cationic polymer available from SNF Floerger, Andrezieux, France under the trade name Flosoft ® 222.

TABLE 2

Key polymer composition levels, viscosity slope, and AUC:Polymer %**
All polymers made in accordance with Example 3

| Polymer | Monomer 1[a] to Monomer 2[b] Ratio | x-link 1[c] | x-link 2[d] | AUC-% Polymer[e] |
|---|---|---|---|---|
| P1 | 3:2 | 0 | 0 | 90% |
| P2 | 3:2 | 0.01% | 0 | 20% |
| P3 | 3:2 | 0.005% | 0 | 36% |
| P4 | 1:1 | 0.01% | 0.02% | 20% |
| P5 | 1:1 | 0 | 0 | 100% |

**% Micro gel = 100%- AUC Polymer %
[a]Monomer 1—2-trimethylaminoethyl acrylates, chloride (TMAEC or DMA3*MeCl)
[b]Monomer 2—Acrylamide (ACM)
[c]X-Link 1—methylene bis-acrylamide (MBA)
[d]X-Link 2—tetraallylammonium chloride (TAAC)
[e]AUC % Polymer is equivalent to water-soluble polymer content as determined by the Analytical Ultracentrifugation technique described herein

TABLE 3 finished product deposition performance in example Formula II using polymers from Table 1

| Cationic Polymer | Polymer Level (wt. %) | Formula | Initial Brookfield Viscosity (cPs) | After 12 wks @ 35° C. Brookfield Viscosity (cPs) | After 12 wks @ 35° C. Physical Stability | Softener (mg/g Fabric) | Silicone (ug/g Fabric) |
|---|---|---|---|---|---|---|---|
| P1 | 0.2 | FII | 132 | 233 | 5% split | 0.3 | 111 |
| P2 | 0.2 | FII | 105 | 181 | stable | 2.2 | 122 |
| P3 | 0.2 | FII | 379 | 494 | stable, but high visc. | 1.6 | 176 |
| P4 | 0.2 | FII | 28 | 39 | stable | 0.7 | 21 |
| CP1 | 0.2 | FII | 251 | 630 | stable, but high visc. | 0.92 | 88 |
| CP1 | 0.25 | FII | 215 | 468 | 5% Split | | |
| CP2 | 0.2 | FII | 109 | 218 | stable | | 44 |

TABLE 4 finished product deposition performance in example Formula IV
Actives Deposition using cationic polymer P5 in Formula IV

| P5 Level (wt. %) | Initial Brookfield Viscosity (cPs) | After 12 wks @ 35° C. Brookfield Viscosity (cPs) | After 12 wks @ 35° C. Physical Stability | Silicone (ug/g Fabric) |
|---|---|---|---|---|
| 0.015 | 43 | 191 | stable | 99 |
| 0.0 | 45 | 192 | stable | 31 |

Example Formulas

The following are non-limiting examples of the fabric treatment compositions of the present invention.

| (% wt) | FI | FII | FIII | FIV | FV |
|---|---|---|---|---|---|
| FSA [a] | 11 | 11 | 7 | 11 | 17 |
| Low MW Alcohol [b] | 1.00 | 1.00 | 0.6 | 1.00 | 0.7 |
| Structurant [c] | — | — | — | 0.075 | — |
| Perfume | 1.75 | 1.75 | 0.56 | 1.75 | 1.75 |
| Perfume encapsulate [d] | 0.69 | 0.69 | 0.26 | 0.69 | 0.69 |
| Calcium Chloride(ppm) | 547 | 547 | 200 | 547 | 750 |
| Chelant [e] | 0.007 | 0.007 | 0.036 | 0.007 | 0.007 |
| Preservative (ppm) [f] | 5 | 5 | 5 | 5 | 5 |
| Acidulent (ppm) (Formic Acid) | 260 | 260 | 260 | 260 | 260 |
| Antifoam [g] | 0.015 | 0.015 | 0.008 | 0.015 | 0.015 |
| Cationic polymer [h] | 0.20 | 0.20 | 0.30 | 0.015 | 0.15 |
| Water soluble dialkyl quat [i,j] | 0.25 | — | — | — | — |
| Dispersant [k] | — | 1.00 | 0.67 | 1.00 | — |
| Stabilizing Surfactant [i] | | | | | 0.25 |
| PDMS emulsion [m] | | | | | 0.65 |
| Amino-functional Organosiloxane Polymer [n] | 3.00 | 3.00 | 2.00 | 3.00 | — |
| Dye (ppm) | 30 | 30 | 20 | 30 | 30 |
| Hydrochloric Acid | 0.025 | 0.025 | 0.014 | 0.025 | 0.020 |
| Deionized Water | Balance | Balance | Balance | Balance | Balance |

[a] N,N-di(tallowoyloxyethyl)-N,N-dimethylammonium chloride.
[b] Low molecular alcohol such as EtOH or IPA
[c] Cationic polymer available from BASF under the tradename Rheovis ® CDE.
[d] Perfume microcapsules available ex Appleton Papers, Inc.
[e] Diethylenetriaminepentaacetic acid or hydroxyl ethylidene-1,1-diphosphonic acid
[f] 1,2-Benzisothiazolin-3-ONE (BIT)under the trade name Proxel available from Lonza
[g] Silicone antifoam agent available from Dow Corning ® under the trade name DC2310.
[h] Cationic acrylates-acrylamide copolymers P1-P5 and CP1-CP3 from Table 2.
[i] Didecyl dimethyl ammonium chloride under the trade name Bardac ® 2280
[j] Hydrogenated tallowalkyl(2-ethylhexyl)dimethyl ammonium methylsulfate from AkzoNobel under the trade name Arquad ® HTL8-MS
[k] Non-ionic surfactant from BASF under the trade name Lutensol ® XL-70
[l] Non-ionic surfactant, such as TWEEN 20 ™ or TAE80 (tallow ethoxylated alcohol, with average degree of ethoxylation of 80), or cationic surfactant as Berol 648 and Ethoquad ® C 25 from Akzo Nobel
[m] Polydimethylsiloxane emulsion from Dow Corning under the trade name DC346 ®.
[n] Amino-functional Organosiloxane polymer such as aminoethylaminopropylmethylsiloxanedimethylsiloxane copolymer with an amine equivalent of 1500 g/mol or greater (commercially available from Shin-Etsu Silicones under the name KF-861, KF-8002)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this written document shall govern.

While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric treatment composition comprising, based upon total composition weight:

a) from about 0.05% to about 5% of a dialkyl quaternary ammonium compound;

b) from about 0.01% to about 1% of a polymeric material comprising one or more polymers said polymeric material having:

(i) comprising a polymer produced by the process of inverse emulsion polymerization or solution polymerization; and/or (ii) a polymer comprising a multi-dentate cross-linking agent; and at least one ethylenically unsaturated cationic monomer; with the proviso that at least 40% of said polymers' monomeric units are ethylenically unsaturated cationic monomer units and said polymer's overall net charge is cationic;

c.) from about 0.05% to about 10% of a silicone polymer, said silicone polymer having a structure selected from:

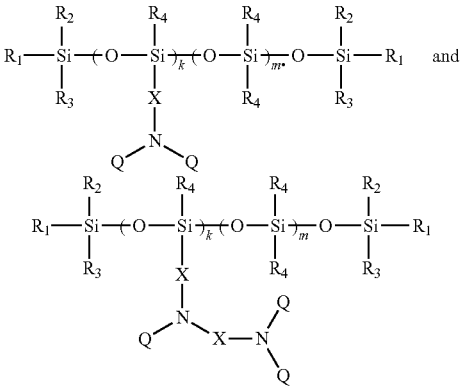

and wherein:

k is an integer from 2 to about 100;

m is an integer from 4 to about 5,000;

each X is a substituted or unsubstituted divalent alkylene radical comprising 2-12 carbon atoms;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, and $C_1$-$C_{32}$ substituted alkoxy;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

wherein at least one Q in said silicone polymer is independently selected from the group consisting of —$CH_2$—CH(OH)—$CH_2$—$R_5$;

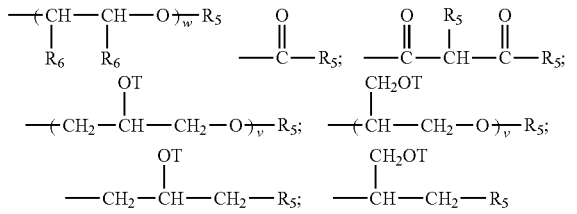

and each additional Q in said silicone polymer is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl; —$CH_2$—CH(OH)—$CH_2$—$R_5$;

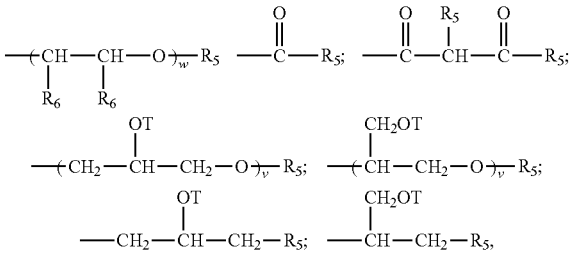

and w is an integer from 1 to about 10;

wherein each $R_5$ is independently selected from the group consisting of H, $C_1$-$C_{32}$ alkyl;

each $R_6$ is independently selected from H, $C_1$-$C_{18}$ alkyl;

each T moiety is independently selected from H, and

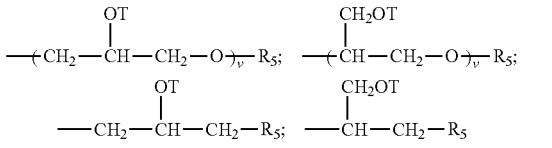

and when v is absent for a respective T moiety said T moiety is H, each v in said silicone polymer is an integer from 1 to about 10, and the sum of all v indices in each Q in the said silicone polymer is an integer from 1 to about 30; and d.) from about 1% to about 30% of a fabric softener active, said composition being a fluid.

2. A fabric treatment composition according to claim 1, wherein said dialkyl quaternary ammonium compound comprises a water-soluble dialkyl quaternary ammonium compound.

3. A fabric treatment composition according to claim 2 wherein said water-soluble dialkyl quaternary ammonium compound is selected from the group consisting of:

a) a material having the structure:

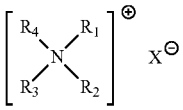

wherein each $R_1$ and $R_2$ are independently $C_8$ to $C_{10}$ hydrocarbyl chains;

$R_3$ and $R_4$ are each methyl; and $X^-$ is a halide or an organic sulphate;

b) a material having the structure

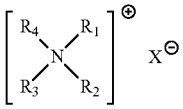

wherein $R_1$ is tallowyl and $R_2$ is 2-ethylhexyl, and $R_3$ and $R_4$ are methyl; and $X^-$ is a halide or an organic sulphate; and c) mixtures thereof.

4. A fabric treatment composition according to claim 1, wherein said silicone polymer is selected from the group consisting of polydimethylsiloxanes, aminosilicones, cationic silicones, silicone polyethers, silicone resins, and mixtures thereof.

5. A fabric treatment composition according to claim 4, wherein said dialkyl quaternary ammonium compound comprises a water-soluble dialkyl quaternary ammonium compound is selected from the group consisting of:

a) a material having the structure:

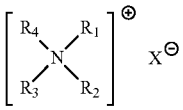

wherein each $R_1$ and $R_2$ are independently $C_6$ to $C_{12}$ hydrocarbyl chains;

$R_3$ and $R_4$ are each independently selected from $C_1$-$C_4$ hydrocarbyl, $C_1$-$C_4$ hydroxy hydrocarbyl, benzyl, —$(C_2H_4O)$xH, wherein x has a value from about 1 to about 10, and mixtures thereof; and $X^-$ is a anion;

b) a material having the structure:

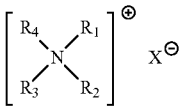

wherein $R_1$ comprises a $C_{12}$ to $C_{22}$ hydrocarbyl chain, $R_2$ comprises a $C_6$ to $C_{12}$ hydrocarbyl chain, wherein $R_1$ has at least two more carbon atoms in the hydrocarbyl chain than $R_2$; $R_3$ and $R_4$ are each independently selected from $C_1$-$C_4$ hydrocarbyl, $C_1$-$C_4$ hydroxy hydrocarbyl, benzyl, —$(C_2H_4O)$xH, wherein x has a value from about 1 to about 10, and mixtures thereof; and $X^-$ is a anion;

c) a material having the structure:

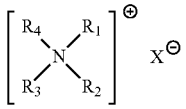

wherein $R_1$ comprises a $C_{12}$ to $C_{22}$ hydrocarbyl chain, $R_2$ and $R_3$ form a saturated or unsaturated ring containing 3-6 hydrocarbyl atoms and may be interrupted by N, O, or S, wherein $R_1$ has at least two more carbon atoms in the hydrocarbyl chain, and $R_4$ is absent when the ring is unsaturated at nitrogen or otherwise is selected from $C_1$-$C_4$ hydrocarbyl, $C_1$-$C_4$ hydroxy hydrocarbyl, benzyl, —$(C_2H_4O)_x$H, wherein x has a value from about 1 to about 10, and mixtures thereof; and $X^-$ is a anion; and d) mixtures thereof.

6. A fabric treatment composition according to claim 5 wherein the water said water-soluble dialkyl quaternary ammonium compound is selected from the group consisting of:

a) a material having the structure:

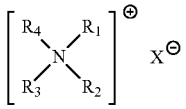

wherein each $R_1$ and $R_2$ are independently $C_8$ to $C_{10}$ hydrocarbyl chains; $R_3$ and $R_4$ are each methyl; and $X^-$ is a halide or an organic sulphate;

b) a material having the structure

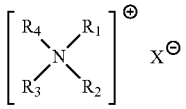

wherein $R_1$ is tallowyl and $R_2$ is 2-ethylhexyl, and $R_3$ and $R_4$ are methyl; and $X^-$ is a halide or an organic sulphate; and c) mixtures thereof.

7. A fabric treatment composition according to claim 1 wherein said silicone polymer has a structure selected from:

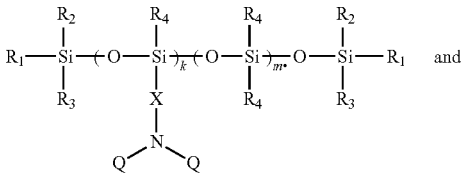

and

-continued

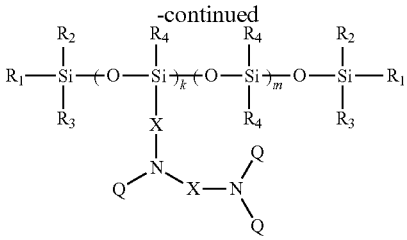

wherein:

k is an integer from 2 to about 10;

m is an integer from 50 to about 500;

$R_1$, $R_2$ and $R_3$ are each independently selected from the group consisting of H, OH, $C_1$-$C_{32}$ alkyl, and $C_1$-$C_{32}$ alkoxy;

each $R_4$ is independently selected from the group consisting of H, OH, $C_1$-$C_{32}$ alkyl, and $C_1$-$C_{32}$ alkoxy;

wherein at least one Q in said silicone polymer is independently selected from the group consisting of

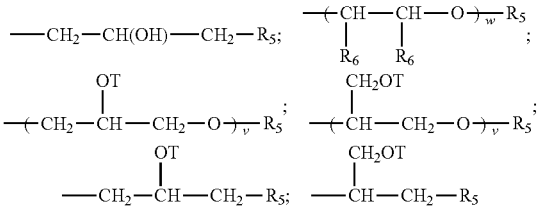

and each additional Q in said silicone polymer is independently selected from the group comprising of H, $C_1$-$C_{32}$ alkyl, $C_1$-$C_{32}$ substituted alkyl;

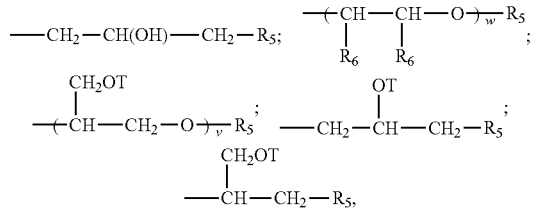

and w is an integer from 1 to about 10;

wherein each $R_5$ is independently selected from the group consisting of H, $C_1$-$C_{32}$ alkyl;

each $R_6$ is independently selected from H, $C_1$-$C_2$ alkyl;

each T moiety is independently selected from H, and

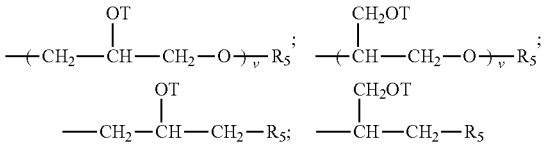

and when v is absent for a respective T moiety said T moiety is H, each v in said silicone polymer is an integer from 1 to about 5, and the sum of all v indices in each Q in the said silicone polymer is an integer from 1 to about 20.

8. A fabric treatment composition according to claim 1, wherein said dialkyl quaternary ammonium compound is selected from the group consisting of:

a) a material having the structure:

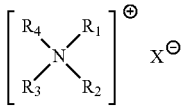

wherein each $R_1$ and $R_2$ are independently $C_6$ to $C_{12}$ hydrocarbyl chains;

$R_3$ and $R_4$ are each independently selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion;

b) a material having the structure:

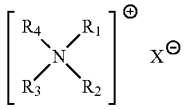

$R_1$ comprises a $C_{12}$ to $C_{22}$ hydrocarbyl chain, $R_2$ comprises a $C_6$ to $C_{12}$ hydrocarbyl chain, wherein $R_1$ has at least two more carbon atoms in the hydrocarbyl chain than $R_2$; $R_3$ and $R_4$ are each independently selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion;

c) a material having the structure:

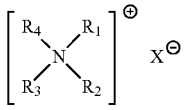

wherein $R_1$ comprises a $C_{12}$ to $C_{22}$ hydrocarbyl chain, $R_2$ and $R_3$ form a saturated or unsaturated ring containing 3-6 hydrocarbyl atoms and may be interrupted by N, O, or S, wherein $R_1$ has at least two more carbon atoms in the hydrocarbyl chain, and $R_4$ is absent when the ring is unsaturated at nitrogen or otherwise is selected from $C_1$-$C_4$ hydrocarbyl, $C_1$-$C_4$ hydroxy hydrocarbyl, benzyl, —$(C_2H_4O)_xH$, wherein x has a value from about 1 to about 10, and mixtures thereof; and $X^-$ is a anion; and d) mixtures thereof.

9. A fabric treatment composition according to claim 1 wherein said fabric softener active is selected from the group consisting of di-tail fabric softener actives, mono-tail fabric softener actives, ion pair fabric softener actives, sucrose ester-based fabric softening actives and mixtures thereof, said composition optionally comprising a softener active selected from the group consisting of amines, fatty esters, dispersible polyolefins, clays, polysaccharides, hydrophobic polysaccharides, imidazolines, fatty oils, polymer latexes and mixtures thereof.

10. A fabric treatment composition according to claim 1 said composition having an initial finished product viscosity of 20-500 cps or 30-400 cps.

11. A fabric treatment composition according to claim 1 said composition having a silicone deposition efficiency index of from about 6% to about 90%.

12. A fabric treatment composition according to claim 1 said composition having a stability index of less than 10% separation after 12 weeks at 35° C.

13. A fabric treatment composition according to claim 1 said composition comprising perfume and/or a perfume delivery system.

14. A process of making a fabric treatment composition comprising adding a combination of silicone polymer according to claim 1 and dialkyl quaternary compound to a softener active that is dispersed in a solvent.

15. A method of treating a fabric comprising contacting said fabric with a composition of claim before, during, or after cleaning said fabric.

16. A fabric treatment composition comprising a polymeric material having:

a) a viscosity slope of from about 3.7 to about 6.5 and/or having a micro gel content of greater than 60%;

b) comprising a polymer produced by the process of inverse emulsion polymerization of dialkyl ammonium halides or compounds according to formula (I):

(I)

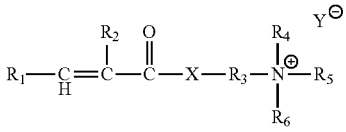

wherein:

$R_1$ is chosen from hydrogen or methyl;

$R_2$ is chosen hydrogen, or $C_1$-$C_4$ alkyl;

$R_3$ is chosen $C_1$-$C_4$ alkylene;

$R_4$, $R_5$, and $R_6$ are each independently chosen from hydrogen, or $C_1$-$C_4$ alkyl;

X is chosen from —O—, or —NH—; and

Y is chosen from Cl, Br, I, hydrogensulfate or methosulfate, and, optionally, non-ionic monomers of formula (II) wherein (II)

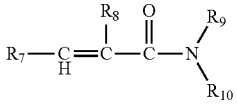

wherein:

$R_7$ is chosen from hydrogen or methyl;

$R_8$ is chosen from hydrogen or $C_1$-$C_4$ alkyl;

$R_9$ and $R_{10}$ are each independently chosen from hydrogen or $C_1$-$C_4$ alkyl, c) a polymer comprising a multi-dentate cross-linking agent selected from the group consisting of divinylbenzene, tetraallylammonium chloride, allyl acrylates, allyl methacrylates, diacrylates and dimethacrylates of glycols or polyglycols, butadiene, 1,7-octadiene, allylacrylamides or allylmethacrylamides, bisacrylamidoacetic acid, N,N'-methylenebisacrylamide or polyol polyallyl ethers, and/or mixtures thereof, and at least one ethylenically unsaturated cationic monomer selected from the group consisting of quaternized dimethylaminoethyl acrylate, quaternized dimethylaminoethyl methacrylate and mixtures thereof; with the proviso that at least 40% of said polymers' monomeric units are ethylenically unsaturated cationic monomer units and said polymer's overall net charge is cationic.

17. A fabric treatment composition according to claim 16 wherein the monomers are dimethyl aminoethyl acrylate methyl chloride and acrylamide.

18. A fabric treatment composition according to claim 17 said composition having a stability index of less than 10% separation after 12 weeks at 35° C.

* * * * *

UNITED STATES PATENT AND TRADEMARK OFFICE

CERTIFICATE OF CORRECTION

PATENT NO. : 9,080,130 B2
APPLICATION NO. : 13/898564
DATED : July 14, 2015
INVENTOR(S) : Mark Robert Sivik et al.

It is certified that error appears in the above-identified patent and that said Letters Patent is hereby corrected as shown below:

IN THE CLAIMS

Claim 15, Column 34
Line 15, after the word claim insert -- 1 --.

Signed and Sealed this
Seventeenth Day of November, 2015

Michelle K. Lee

Michelle K. Lee
*Director of the United States Patent and Trademark Office*